US005548386A

United States Patent [19]

Fukuda

[11] Patent Number: 5,548,386

[45] Date of Patent: Aug. 20, 1996

[54] DEVELOPING APPARATUS AND IMAGE FORMING APPARATUS USING THE DEVELOPING APPARATUS

[75] Inventor: Yoshiyuki Fukuda, Shizuoka-ken, Japan

[73] Assignee: Kabushiki Kaisha TEC, Shizuoka, Japan

[21] Appl. No.: 507,650

[22] Filed: Jul. 25, 1995

[30] Foreign Application Priority Data

Jul. 26, 1994 [JP] Japan ..... 6-174216

[51] Int. Cl.[6] ..... G03G 15/08

[52] U.S. Cl. ..... 355/259; 118/653; 355/245

[58] Field of Search ..... 355/259, 260, 355/245; 118/653, 656; 430/120

[56] References Cited

U.S. PATENT DOCUMENTS

| | | | |
|---|---|---|---|
| 4,458,627 | 7/1984 | Hosono et al. . | |
| 5,138,385 | 8/1992 | Toyoshi et al. | 355/246 |
| 5,389,732 | 2/1995 | Sekino | 118/653 |

FOREIGN PATENT DOCUMENTS

| | | | |
|---|---|---|---|
| 59-30568 | 2/1984 | Japan . | |
| 60-114891 | 6/1985 | Japan | 355/259 |
| 61-28971 | 2/1986 | Japan | 355/259 |
| 62-5270 | 1/1987 | Japan | 355/259 |
| 2-26228 | 6/1990 | Japan . | |

*Primary Examiner*—R. L. Moses
*Attorney, Agent, or Firm*—Frishauf, Holtz, Goodman, Langer & Chick

[57] ABSTRACT

An image forming apparatus for forming an image in accordance with an external signal comprises a photosensitive drum, a charging unit for charging the surface of the photosensitive drum at a predetermined potential, an exposing unit for exposing the surface of the photosensitive drum and forming an electrostatic latent image, a developing apparatus for developing the electrostatic latent image on the photosensitive drum and forming a visible image, a transfer unit for transferring the visible image on the photosensitive drum onto a medium, and a fixing unit for fixing the visible image transferred onto the medium. The developing apparatus includes a storing unit for storing a toner, a developing roller rotated about a horizontal axis to supply the toner to the photosensitive drum, a guide member for defining a temporary storage space of the toner in cooperation with a downwardly rotating surface of the developing roller at a position higher than a horizontal ideal plane passing through an axis of the developing roller, and for adhering to the developing roller the toner moving downward within the storage space by the weight of the toner itself, a layer thickness limiting member for regulating the thickness of the toner adhered to the developing roller at a constant value, and an ejecting device for ejecting the toner from the storing unit into the storage space.

12 Claims, 9 Drawing Sheets

| TYPE OF TONER SUPPLY GUIDE | | EXAMPLES OF SUITABLE MATERIALS |
|---|---|---|
| a | PLATE-TYPE | POLYCARBONATE PLATE, ACRYLONITRILE-BUTADIENE-STYRENE (ABS) PLATE, IRON PLATE, STAINLESS STEEL PLATE, PHOSPHOR BRONZE PLATE, BRASS PLATE |
| b | SPONGE-TYPE | URETHANE SPONGE, CHLOROPRENE SPONGE, CONDUCTIVE URETHANE SPONGE |
| c | RUBBER PLATE-TYPE | URETHANE RUBBER, SILICONE RUBBER, CONDUCTIVE URETHANE RUBBER, CONDUCTIVE SILICONE RUBBER |
| d | FILM-TYPE | POLYETHYLENE TEREPHTHALATE FILM, CARBON-DISPERSED FILM, CONDUCTIVE POLYCARBONATE FILM, CONDUCTIVE POLYIMIDE CARBONATE FILM, CONDUCTIVE NYLON CARBONATE FILM, CONDUCTIVE THERMOPLASTIC POLYIMIDE CARBONATE FILM, CONDUCTIVE POLYETHER ETHER KETONE CARBONATE FILM, PHOSPHOR BRONZE FILM |

FIG. 16

DEVELOPING APPARATUS AND IMAGE FORMING APPARATUS USING THE DEVELOPING APPARATUS

BACKGROUND OF THE INVENTION

1. Field of the Invention

The present invention relates to an image forming apparatus such as an electronic photographing apparatus, and to a developing apparatus provided in the image forming apparatus.

2. Description of the Related Art

In general, an image forming apparatus such as a copying machine comprises a photosensitive body on which an electrostatic latent image corresponding to a desired image is formed; a charging apparatus for charging the surface of the photosensitive body at a predetermined potential; an exposing apparatus for exposing the photosensitive body and forming an electrostatic latent image thereon; a developing apparatus for developing the electrostatic latent image and forming a visible image; a sheet feed unit for feeding a recording paper sheet to the vicinity of the photosensitive body; a transfer apparatus for transferring the developed visible image onto the fed paper sheet; and a fixing apparatus for fixing the visible image transferred onto the recording paper sheet.

In the image forming apparatus, at first, the surface of the photosensitive body is uniformly charged by the charging apparatus at the time of image formation. At this time, the surface potential of the photosensitive body is charged at, e.g. −500 V. Next, the photosensitive body is exposed by the exposing apparatus on the basis of image data. At this time, the surface potential of the exposed region, i.e. the region with the electrostatic latent image, is, for example, −50 V, and the surface potential of the non-exposed region is kept at −500 V. Toner charged at, e.g. −200 V is adsorbed on the electrostatic latent image on the photosensitive body by the developing apparatus and the electrostatic latent image is visualized. In other words, the electrostatic latent image is developed and a toner image is formed. The toner image is transferred onto the recording paper sheet fed from the sheet feed unit by the transfer apparatus. The transferred toner image is fixed by the fixing apparatus.

An example of the developing apparatus provided in the image forming apparatus is a developing apparatus 100 using non-magnetic one-component toner. As is shown in FIG. 1, the developing apparatus 100 comprises a developing roller 102, a supply roller 104, a layer thickness limiting member 106, a stirring paddle 108 and a body casing 110 containing these structural elements 102, 104, 106 and 108. The body casing 110 has a toner container 112 for containing toner. A front opening of the body casing 110 is situated to face the photosensitive body 200. In addition, the developing roller 102 is provided at the front opening of the body casing 110 such that the roller 102 is rotatable in a predetermined direction.

The supply roller 104 is provided such that the roller 104 can rotate while closely contacting the developing roller 102 and toner T can be supplied from the toner container 112 to the outer peripheral surface of the developing roller 102. Specifically, the supply roller 104 extends in a direction perpendicular to the surface of the sheet of FIG. 1 and comprises a shaft member **104*s* rotated in the same direction as the developing roller 102 by an external driving mechanism and a cylindrical roller member 104*r* formed of an elastic material such as sponge and fitted on the shaft member 104*s***.

The layer thickness limiting member 106 has a thin plate shape and a proximal end portion thereof is fixed to a front portion of the body casing 110. A distal end portion of the layer thickness limiting member 106 is provided with a toner layer limiting member **106*a* formed of an elastic material. The toner layer limiting member 106*a* is put in pressure contact on the outer peripheral surface of the developing roller 102. The toner T supplied on the outer peripheral surface of the developing roller 102 by means of the supply roller 104 is electrified by the toner layer limiting member 106*a***, and a thin toner layer of predetermined thickness can be formed.

The stirring paddle 108 is rotatably provided within the toner container 112, thereby to prevent cohesion of toner and supply toner to the supply roller 104.

In the developing apparatus having the above structure, when an image is to be formed, a toner layer formed on the outer peripheral surface **102*s* of the developing roller 102 comes into contact with the photosensitive body 200, and the toner is supplied to the region of the electrostatic latent image (the exposed region) of the photosensitive body 200. The toner not supplied on the photosensitive body 200 and left on the developing roller 102 passes through a recovery sheet 114 and is recovered into the body casing 110**.

Jap. Pat. Appln. KOKOKU Publication No. 5-10672 discloses toner supply device using no supply roller. According to this toner supply device, toner is pushed and supplied into a gap between a toner reservoir, which faces a developing roller in a non-contact manner, and the developing roller by means of a paddle for drawing up toner from a toner container.

In the method using the supply roller, a mechanism and energy (torque) for rotating the supply roller, in addition to the developing roller and stirring paddle, are required, resulting in a higher cost. Since the miniaturization of the supply roller itself is limited, it is difficult to reduce the size of the apparatus and simplifying the structure of the apparatus.

On the other hand, in the method using no supply roller, the above-mentioned problems are less serious. However, it is difficult to stably supply toner to the region closest to the developing roller. In addition, it is difficult to stably apply pressure to the toner in order to adhere the toner to the developing roller.

Specifically, in the developing apparatus described in Jap. Pat. KOKOKU Publication No. 5-10672, toner is supplied from the toner reservoir provided near the lower part of the developing roller, the amount of toner supplied to the region closest to the developing roller tends to be deficient. Moreover, a blur of images and a decrease in toner density may occur due to deficient pressure on the toner. Besides, the toner may be excessively pushed and supplied by the toner draw-up member, resulting in cohesion of toner and deficient supply of toner.

In a developing apparatus described in Jap. Pat. KOKOKU Publication No. 2-26228, a toner container is situated above a developing roller, and a toner layer thickness limiting blade for supplying toner is provided in contact with or with a gap from the developing roller near the outlet of the toner container.

In this developer apparatus, however, the weight of toner itself acts on the toner in the toner container and the toner tends to cohere due to excessive pressure. As a result, the toner does not uniformly adhere to the developing roller, and parts of a printed image may miss in white stripes.

SUMMARY OF THE INVENTION

The object of the present invention is to provide a developing apparatus capable of stably, smoothly supplying a developer to a developing roller at low cost, and an image forming apparatus using the developing apparatus.

The object is achieved by a developing apparatus for developing an electrostatic latent image formed on an image bearing body, the apparatus comprising:

a storing unit for storing a developer;

a developing roller rotated about a horizontal axis to supply the developer to the image bearing body;

a guide member, put in contact with a downwardly moving upper peripheral surface of the developing roller, for defining a temporary storage space of the developer along with the developing roller and for adhering to the developing roller the developer moving downward within the storage space by the weight of the toner itself;

charging means for charging the developer adhered to the developing roller; and ejecting means for ejecting the developer from the storing unit into the storage space.

The object is also achieved by an image forming apparatus for forming an image in accordance with an external signal, the apparatus comprising:

an image bearing body;

charging means for charging the surface of the image bearing body at a predetermined potential;

exposing means for exposing the surface of the image bearing body in accordance with the external signal and forming an electrostatic latent image;

developing means for developing the electrostatic latent image on the image bearing body and forming a visible image, including a storing unit for storing a developer, a developing roller rotated about a horizontal axis to supply the developer to the image bearing body, a guide member for defining a temporary storage space of the developer in cooperation with a downwardly rotating surface of the developing roller at a position higher than a horizontal ideal plane passing through an axis of the developing roller, and for adhering to the developing roller the developer moving downward within the storage space by the weight of the toner itself, a layer thickness limiting member for regulating the thickness of the developer adhered to the developing roller at a constant value, and ejecting means for ejecting the developer from the storing unit into the storage space;

transfer means for transferring the visible image on the image bearing body onto a medium; and fixing means for fixing the visible image transferred onto the medium.

According to the present invention, the developer stored in the storing unit is stirred by the ejecting means and supplied into the storage space. Thus, there is no need to provide a stirring device for stirring the developer or a supply roller for supplying the developer to the developing roller. Therefore, the mechanism of the apparatus is simplified and energy is saved. In addition, the size of the apparatus can be reduced and the manufacturing cost thereof can be decreased.

The guide member is put in contact with a downwardly moving upper peripheral surface of the developing roller, thus defining a temporary storage space of the developer along with the developing roller. Specifically, the guide member is situated such that the developer is moved to the developing roller side by the weight of the developer itself and the direction of movement of developer coincides substantially with the direction of rotation of the developing roller. Thus, the developer can be stably, smoothly supplied to the developing roller by the synergetic effect of the movement of the developer by its own weight and the torque of the developing roller.

Furthermore, since the developer is ejected from the storing unit into the storage space by the ejecting means, cohesion of the developer is prevented. Accordingly, the developer can be uniformly adhered to the developing roller.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

FIG. 16 shows examples of the usable material of the toner supply guide in the developing apparatus of the invention.

DETAILED DESCRIPTION OF THE PREFERRED EMBODIMENTS

Embodiments of the developing apparatus and the image forming apparatus using the developing apparatus according to the present invention will now be described.

A first embodiment of the invention will first be described with reference to FIGS. 2 to 5.

Figure 3:
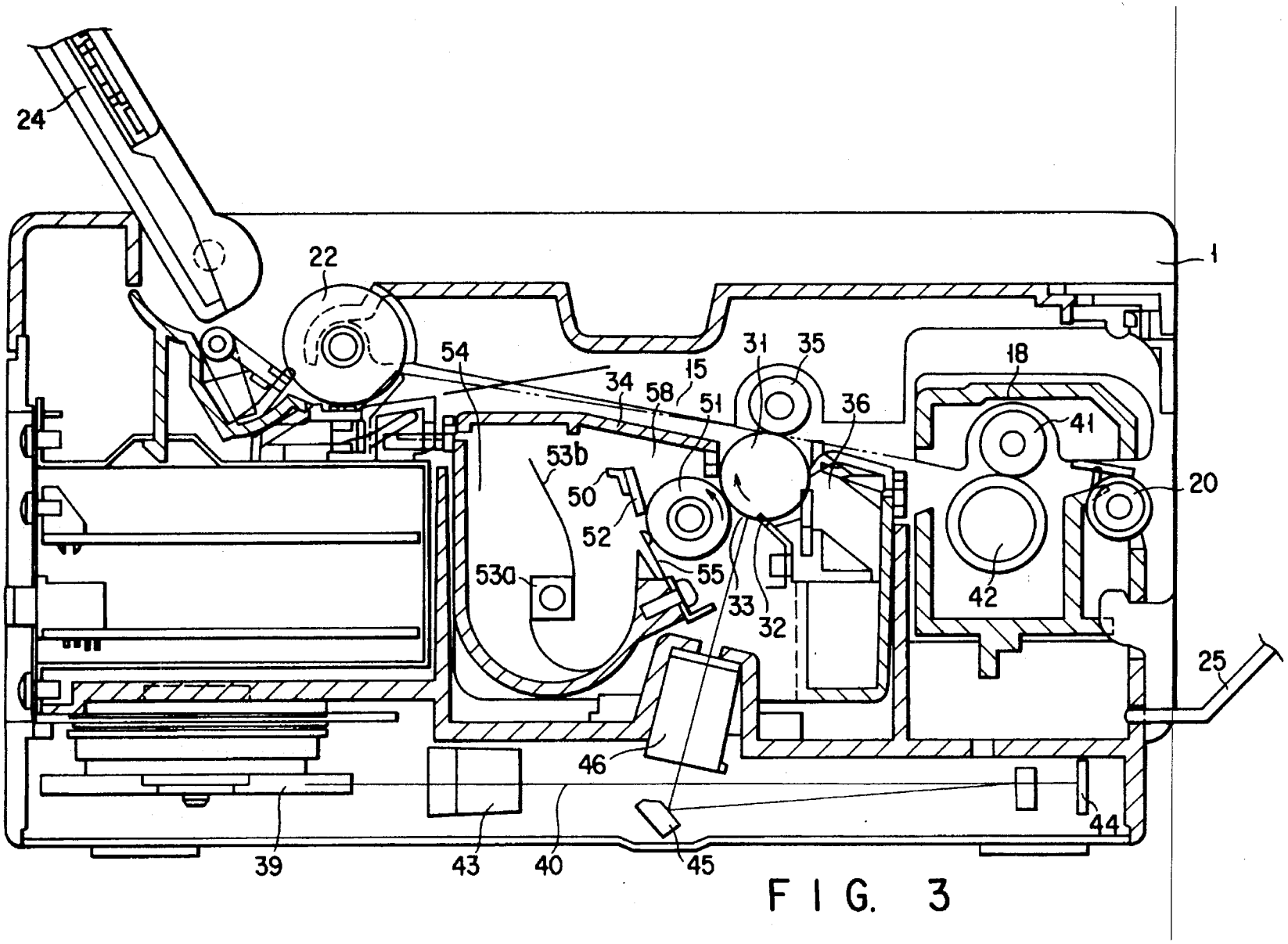
FIG. 3 is a cross-sectional view schematically showing an image forming apparatus including the developing apparatus shown in FIG. 2.

FIG. 3 schematically shows the entire structure of an image forming apparatus including a developing apparatus according to the present invention. A photosensitive drum 31 is rotatably disposed within an apparatus body 1. The photosensitive drum 31 is surrounded successively in the rotational direction by a charger 32 for charging the surface of the photosensitive drum 31 at a predetermined potential, an exposing section 33 in which the charged photosensitive drum 31 is exposed and an electrostatic latent image is formed, a developing apparatus 34 including developing roller 51 for supplying non-magnetic one-component toner as a developer, for developing the electrostatic latent image formed on the photosensitive drum 31, a transfer roller 35 for transferring a developed toner image onto a paper sheet, and a cleaner 36 for removing residual charge and toner from the surface of the photosensitive drum 31.

A polygon mirror 39 for scanning an image information beam corresponding to an image to be formed is disposed in a lower part of the apparatus body 1. The beam scanned by the polygon mirror 39 is led to the exposing section 33 on the photosensitive drum 31 via an optical system 40. The optical system 40 comprises a lens 43, first and second reflection mirrors 44 and 45, and a lens 46.

A sheet feed path 15 is provided substantially horizontally in an upper part of the apparatus body 1. A sheet feed roller 22, the photosensitive drum 31, the transfer roller 35, a fixing apparatus 18 and a discharge roller 20 are provided successively along the sheet feed path 15 in the sheet feed direction. The fixing apparatus 18 comprises a heat roller 41 and a press roller 42 put in rotatable contact with the heat roller 41. A sheet feed tray 24 for containing and feeding paper sheets is provided on an upper surface portion of the apparatus body 1. A discharged sheet tray 25 for receiving sheets discharged by the discharge roller 20 is provided on one side of the apparatus body 1.

The image forming operation of the above image forming apparatus will now be described. The surface of the photosensitive drum 31 is uniformly charged at a predetermined potential by the charger 32. At the same time, an image information beam corresponding to image data sent from a transmission system (not shown) is scanned by the rotating polygon mirror 39 and radiated on the exposing section 33 on the surface of the photosensitive drum 31 via the optical system 40. The photosensitive drum 31 is thus exposed and an electrostatic latent image is formed on the surface of the photosensitive drum 31. The electrostatic latent image is developed into a visible image by the developing apparatus. Specifically, toner is supplied from the developing roller 51 to the electrostatic latent image and the latent image is converted to a toner image.

On the other hand, at this time, a paper sheet is fed from the sheet feed tray 24 by the sheet feed roller 22 along the sheet feed path 15. The sheet is conveyed along the path 15 to the image transfer section between the photosensitive drum 31 and the transfer roller 35. At this time, skew of the sheet is corrected and the front end of the toner image formed on the photosensitive drum 31 is aligned with the front end of the sheet. Then, the sheet is sent to the image transfer section. In the image transfer section, the toner image on the photosensitive drum 31 is transferred onto the sheet. The sheet on which the toner image has been transferred is separated from the photosensitive drum 31 and sent into a contact region between the heat roller 41 and press roller 42 in the fixing apparatus 18. The sheet sent to the fixing apparatus 18 is heated and pressed and the toner image is fixed on the sheet. The sheet with the fixed toner image is discharged to the discharged sheet tray 25 by the discharge roller 20.

The developing apparatus 34 of the present invention will now be described in detail with reference to FIG. 2.

The developing apparatus 34 is suitable for the "overpass" type structure wherein the sheet P passes over the developing apparatus 34 and photosensitive drum 31.

The developing apparatus 34 comprises a developing roller 51 for supplying toner to the photosensitive drum 31; a toner container 54 partitioned by a lattice-shaped partition member 59; and a toner reservoir 58 for temporarily storing toner and supplying the toner to the developing roller 51.

A lower end portion of a toner supply guide 52 formed of an elastic material and attached to an upper end portion of the partition member 59 by means of a holder 50 is put in contact with the developing roller 51. In addition, a layer thickness limiting member 55 is located below the toner supply guide 52, and constituted by a supporting plate 55 and a projection 55*a*. The projection 55*a* is formed on the upper end of the supporting plate 55 and extends in parallel with the rotational shaft of the developing roller 51. The projection 55*a* is put in contact with the surface of the developing roller 51, so that a toner adhered to the developing roller 51 is formed into a toner layer with uniform thickness. The projection 55*a* is formed of, e.g. silicone and a potential necessary for development is applied to the toner.

The toner supply guide 52 and layer thickness limiting member 55 are separated from the toner container 54 by the lattice-shaped partition member 59. The toner container 54 contains non-magnetic one-component toner 57. A toner supply apparatus 53 is disposed within the toner container 54. The toner supply apparatus 53 stirs the toner in the toner container 54 and supplies the toner to the toner reservoir 58. The toner supply apparatus 53 comprises a paddle 53*a*, which is rotatable on a rotational shaft in a direction indicated by an arrow in FIG. 2, and a thin elastic member 53*b* attached to the paddle 53*a*. The thin elastic member is formed of a synthetic resin such as polyester film or polycarbonate.

On the other hand, the toner reservoir 58 is defined by the toner supply guide 52, the upper surface of the developing roller 51 and a top plate 60 covering the developing apparatus 34.

The material of the toner supply guide 52 will be described later in detail.

In the developing apparatus having the above structure, when an image is formed, toner is supplied in the following manner. Specifically, when the paddle 53*a* is rotated, the elastic thin plate 53*b* attached to the paddle 53*a* is also rotated. While the elastic thin plate 53*b* is being rotated from the lower region of the toner container to the upper region, the elastic thin plate 53*b* bends and sweeps up the toner. The bent thin elastic member 53*b* straightens in the upper region of the toner container 54. The swept-up toner is dispersed by synergetic effect of the torque of the thin elastic member 53*b* and the straightening action of the elastic member 53*b*. The toner is supplied to the toner reservoir 58 via a gap between the holder 50 and the top plate 60.

The distal end portion of the thin elastic member 53*b* attached to the paddle 53*a* rotates along the partition member 59, without coming into contact with the upper end portion of the toner supply guide 52. Specifically, the thin elastic member 53*b* is provided such that when the distal end portion of the elastic member 53*b* approaches the upper end portion of the toner supply guide 52, the distal end portion of the elastic member 53*b* does not project above the upper end portion of the supply guide 52. Thus, when the thin elastic member 53*b* is rotated, the distal end portion thereof does not forcibly push the toner into the toner reservoir 58. Accordingly, the amount of toner in the toner reservoir 58 does not exceed the volume defined by the developing roller 51, toner supply guide 52 and top plate 60, and the toner does not cohere in the toner reservoir 58.

Figure 4:
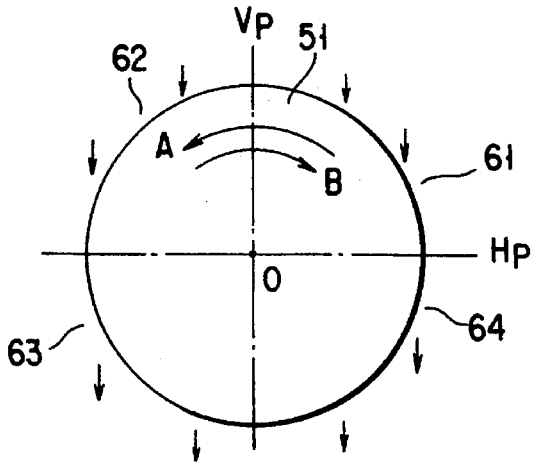
FIG. 4 is a view for illustrating the position where a toner supply guide is disposed in the developing apparatus of the image forming apparatus shown in FIG. 3.
Figure 5:
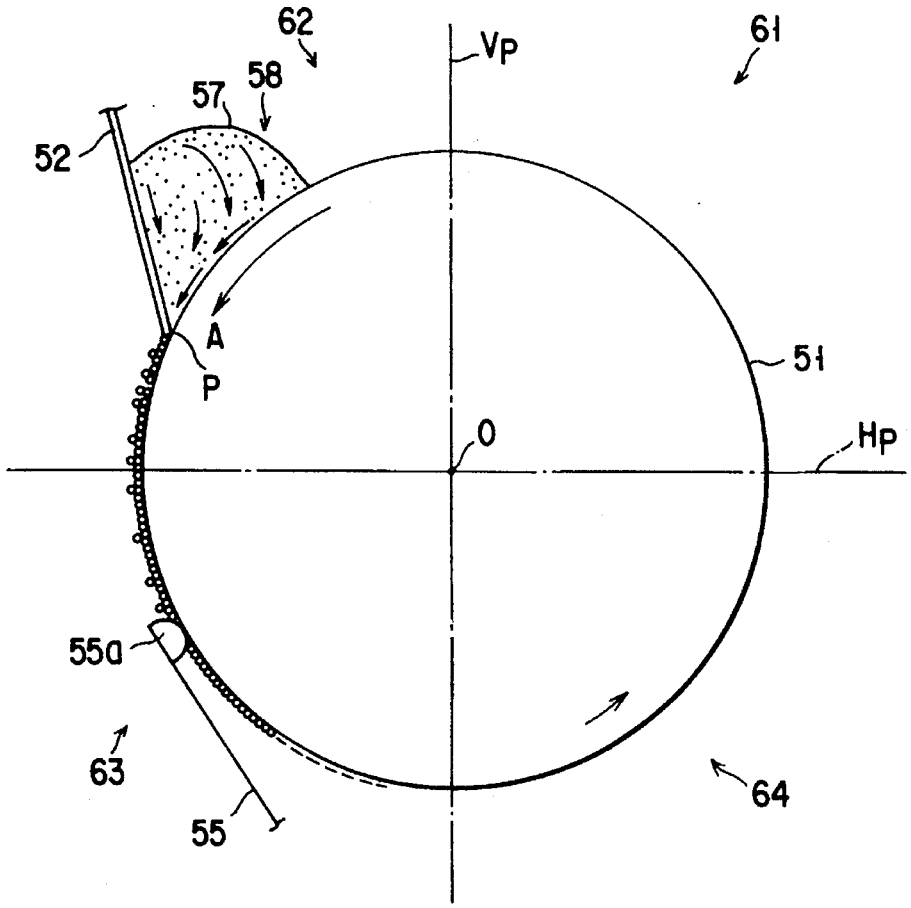
FIG. 5 is a view showing toner guided by the toner supply guide of the developing apparatus shown in FIG. 3.

FIG. 4 shows in detail the position of the toner supply guide 52. The cross section of the developing roller 51 is divided into four regions 61, 62, 63 and 64 by a horizontal plane HP and a vertical plane VP passing through an axis O of the developing roller 51. When the developing roller 51 rotates in a direction A, the toner supply guide 52 is situated in the region 62. When the roller 51 rotates in a direction B, the supply guide 52 is situated in the region 61. For example, the toner supply guide 52 is positioned in the region 62, as shown in FIG. 5. In this position, toner 57 near the developing roller 51 can be supplied from the toner reservoir 58 in the rotational direction of the roller 51 by the weight of the toner 57 itself.

In FIG. 5, the toner supply guide 52 is situated in the region 62. When the developing roller rotates in the direction A, the torque of the developing roller 51 and the moving force of toner by the weight of toner itself are combined at a contact point P between the developing roller 51 and toner supply guide 52, i.e. a pressure application point. Thus, stable supply of toner at stable pressure can be effected.

The toner adhered to the developing roller 51 at the contact point P is formed into a toner layer with uniform thickness by the projection 55*a* of the layer thickness limiting member 55. In addition, a potential necessary for development is applied to the toner by the projection 55*a*.

The lattice-shaped partition member 59 is provided within the toner container 54 to separate the paddle 53*a* from the toner supply guide 52 and layer thickness limiting member 55. The distal end portion of the elastic thin member 53*b* slides on the partition member 59 as the paddle 53*a* rotates, and does not come into direct pressure contact with the toner supply guide 52 or layer thickness limiting member 55. Accordingly, the toner layer with uniform thickness is formed on the developing roller 51, and a good toner image can be formed on the photosensitive drum 51.

According to the developing apparatus of this embodiment, toner does not cohere and is stably supplied, and the apparatus can be reduced in size and simplified.

The amount of toner supplied to the developing roller 51 is more than the amount necessary for development, and the toner is not charged. The excess toner is removed by the layer thickness limiting member 55, and only a necessary amount of toner is supplied as a toner layer on the developing roller 51 and charged.

The toner layer on the developing roller 51 comes into contact with the photosensitive drum 31 and thus the electrostatic latent image on the photosensitive drum 31 is developed.

The excess toner removed by the layer thickness limiting member 55 is recovered into the toner container 54 in which the toner container and a recovery chamber are integrated, and the recovered toner is used once again.

Figure 6:
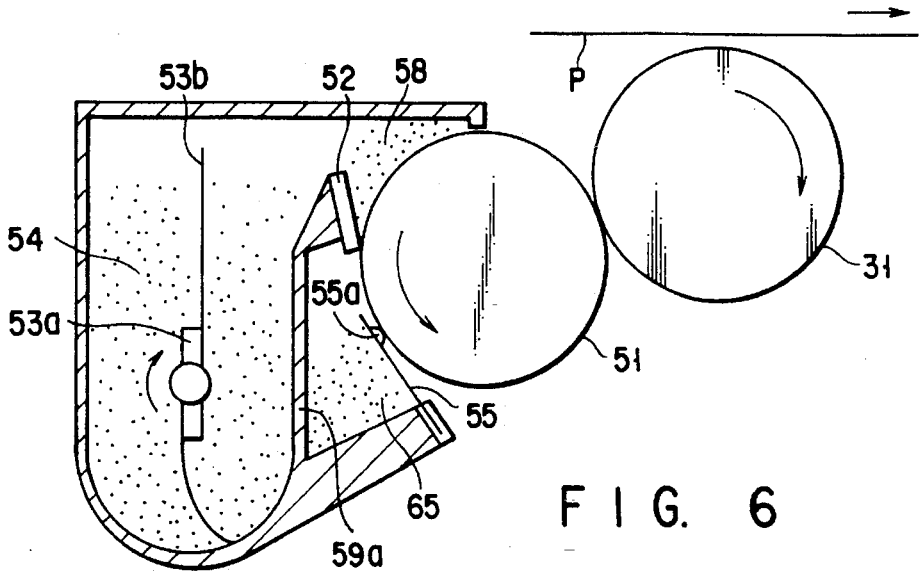
FIG. 6 is a cross-sectional view showing a developing apparatus according to a second embodiment of the invention.

FIG. 6 shows a second embodiment of the developing apparatus of the present invention. The developing apparatus includes a plate-shaped partition member 59a for partitioning a toner container 54. Excess toner removed by the layer thickness limiting member 55 is stored in an excess toner recovery chamber 65. In this manner, the stored excess toner may be recovered later.

Figure 7:
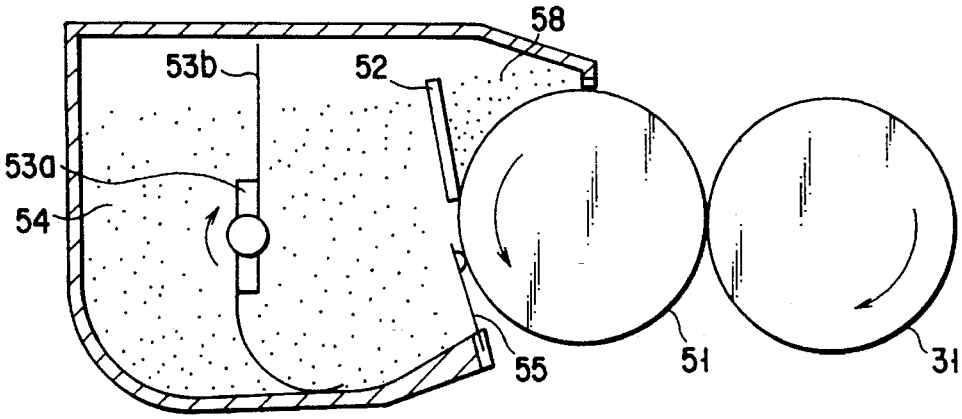
FIG. 7 is a cross-sectional view schematically showing a developing apparatus according to a third embodiment of the invention.

FIG. 7 shows a third embodiment of the developing apparatus of the invention. FIG. 7 and the following figures do not show the partition member for the purpose of simplicity of descriptions.

In this embodiment, the photosensitive drum 31 is situated substantially on the same level as the developing roller 51. The sheet P can be passed both above and below the developing apparatus 34 and photosensitive drum 31. Thus, the developing apparatus has a thin structure. The developing apparatus of this embodiment is suitable for a thin-structure image forming apparatus and a color image forming apparatus in which a plurality of developing apparatuses are combined.

Figure 1:
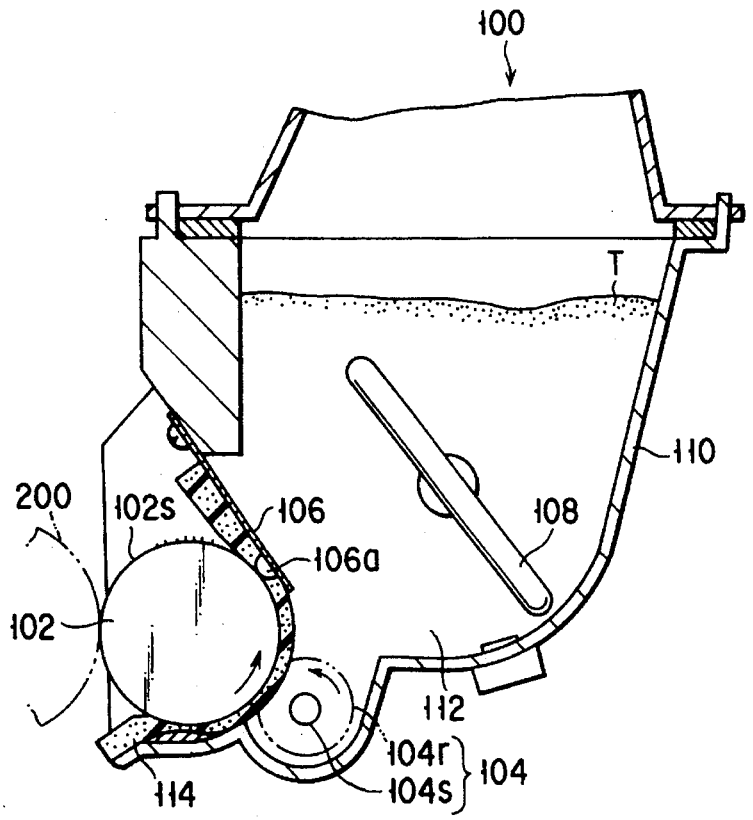
FIG. 1 (PRIOR ART)
FIG. 1 is a cross-sectional view schematically showing a conventional developing apparatus.
Figure 2:
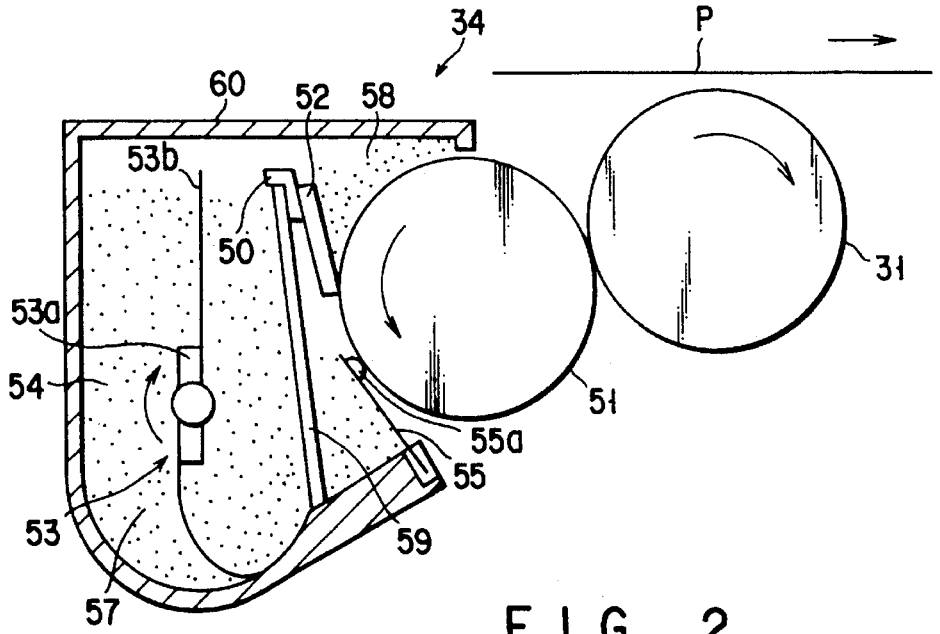
FIG. 2 is a cross-sectional view showing a developing apparatus according to a first embodiment of the present invention.

The structural elements already shown in FIG. 2 are denoted by like reference numerals and a description thereof is omitted.

Figure 8:
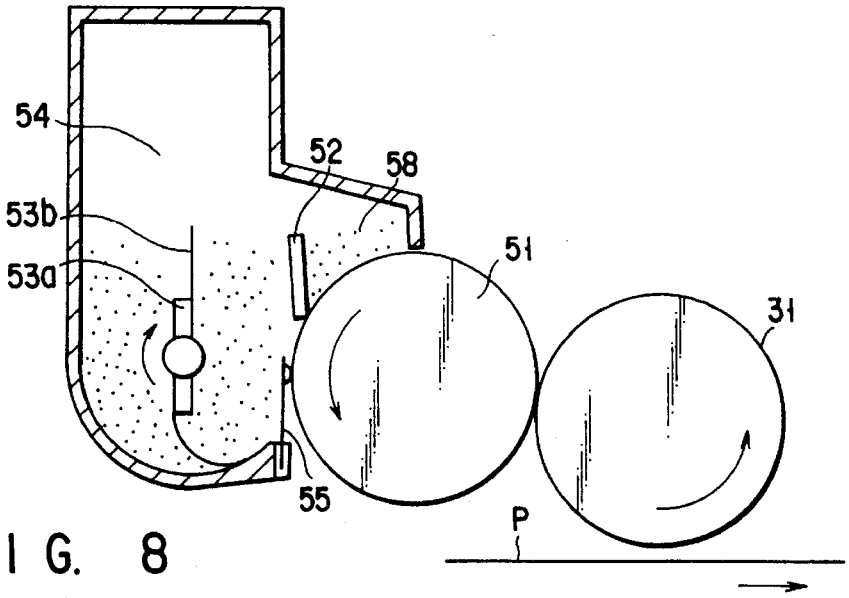
FIG. 8 is a cross-sectional view schematically showing a developing apparatus according to a fourth embodiment of the invention.

FIG. 8 shows a fourth embodiment of the present invention.

In the fourth embodiment, the photosensitive drum 31 is situated on a lower level than the developing roller 51. This embodiment is suitable for a "under-pass" type structure in which the sheet P passes below the developing apparatus 34 and photosensitive drum 31.

The structural elements already shown in FIG. 2 are denoted by like reference numerals and a description thereof is omitted.

Figure 9A:
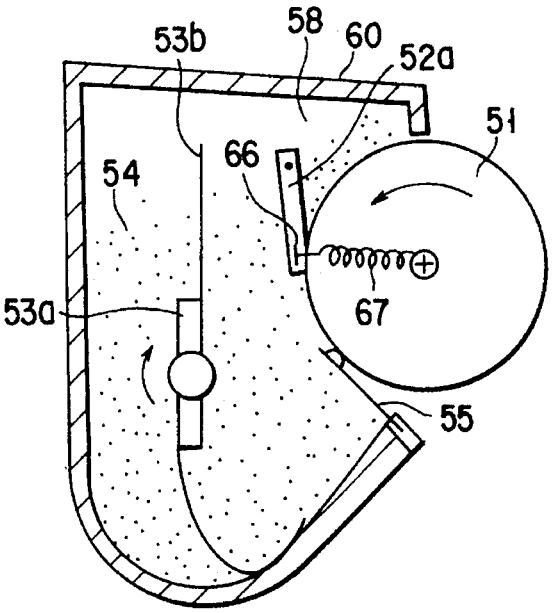
FIG. 9A is a side view showing a developing apparatus having a first toner supply guide.
Figure 9B:
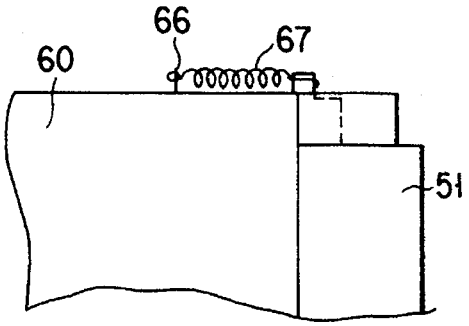
FIG. 9B is a top view of a part of the developing apparatus shown in FIG. 9A.
Figure 9C:
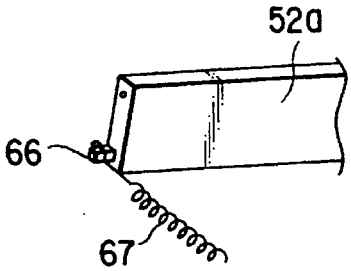
FIG. 9C is a perspective view showing a toner supply guide and an urging mechanism of the developing apparatus shown in FIG. 9A.

FIG. 9A is a side view showing a developing apparatus having a first toner supply guide 52*a*. An upper end portion of the first toner supply guide 52*a* is rotatably support, and a lower end portion thereof is put in contact with the developing roller 51. As is shown in FIGS. 9B and 9C, both side surfaces of the lower end portion of the first toner supply guide 52*a* are provided with hook pins 66. Springs 67 are connected at one end to the hook pins 66 and at the other end to a rotational shaft of the developing roller 51. The springs 67 urge the first toner supply guide 52*a* towards the developing roller 51. By virtue of the urging force, the lower end portion of the first toner supply guide 52*a* is put in pressure contact with the developing roller 51.

The first toner supply guide 52*a* is a flat plate member about 0.5 to 2 mm thick, as shown in FIG. 9C, and is made of materials of type (a) in FIG. 16. The first toner supply guide 52*a* is, for example, a polycarbonate plate, acrylonitrile-butadiene-styrene (ABS) plate, or a iron plate.

Figure 10A:
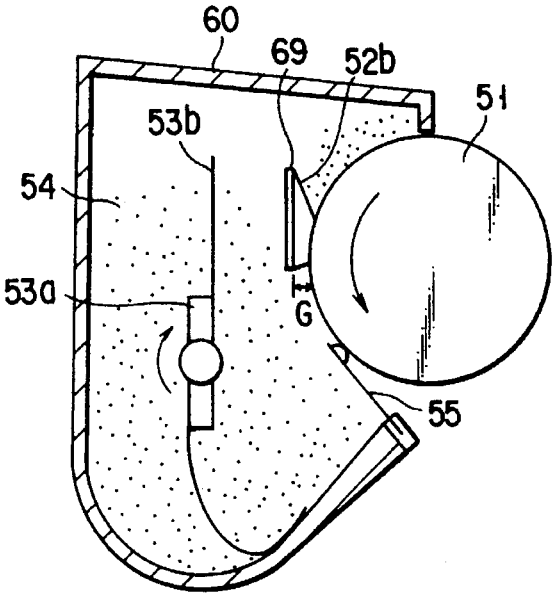
FIG. 10A is a side view showing a developing apparatus having a second toner supply guide.
Figure 10B:
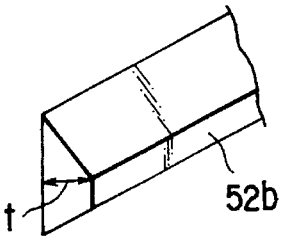
FIG. 10B is a perspective view showing the second toner supply guide of the developing apparatus shown in FIG. 10A.

FIG. 10A is a side view showing a developing apparatus having a second toner supply guide 52*b*. The second toner supply guide 52*b* is formed in a shape, as shown in FIG. 10B. The second toner supply guide 52*b* is formed of a material of type (b) in FIG. 16, for example, urethane sponge (rigidity: 5° to 20°, Japan Industrial Standard ASKER-C). The second toner supply guide 52*b* is adhered to a holder 69 provided immovably and in non-contact with the developing roller 51. As is shown in FIG. 10A, a gap G between the holder 69 and developing roller 51 is set to be less than the thickness t of the second toner supply guide 52*b*. By virtue of this dimensional relationship, the second toner supply guide 52*b* is put in pressure-contact with the developing roller 51. In this case, the second toner supply guide 52*b* is urged to the developing roller 51 by the elastic force of the second toner supply guide 52*b* itself. The contact pressure of the second toner supply guide 52*b* on the developing roller 51 is controlled by the rigidity and thickness of the toner supply guide 52*b*.

Figure 11A:
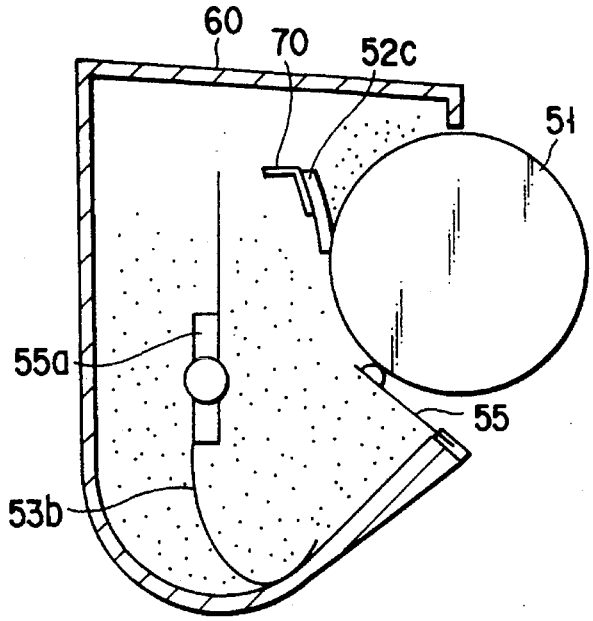
FIG. 11A is a side view showing a developing apparatus having a third toner supply guide.
Figure 11B:
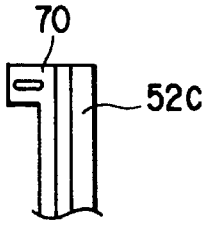
FIG. 11B is a top view of a part of the third toner supply guide shown in FIG. 11A.
Figure 11C:
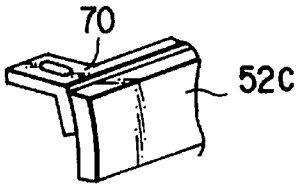
FIG. 11C is a perspective view showing a part of the third toner supply guide shown in FIG. 11A.

FIG. 11A is a side view showing a developing apparatus having a third toner supply guide 52*c*. As is shown in FIGS. 11A, 11B and 11C, the third toner supply guide 52*c* is formed of a rubber material of type (c) in FIG. 16 in a plate-like shape. An upper part of the third toner supply guide 52*c* is attached to a holder 70. The holder 70 is situated near the developing roller 51 so that a free-end portion of the third toner supply guide 52*c* bites into the developing roller 51 by a degree of about 0.5 to 1.5 mm. Thus, the third toner supply guide 52*c* is warped along the outer peripheral surface of the developing roller. The toner supply guide 52*c* is pressed on the developing roller 51 by the restoring force of the warped,toner supply guide 52*c* itself. The contact pressure is determined by the thickness of the third toner supply guide 52*c*, the length of the portion of the guide 52*c* projecting from the holder 70, the rigidity of the guide 52*c*, and the amount of biting of the guide 52*c* into the developing roller 51.

Figure 11D:
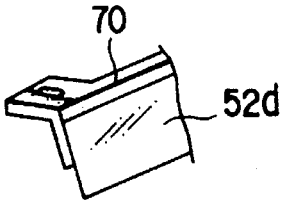
FIG. 11D is a perspective view showing a part of a fourth toner supply guide.

FIG. 11D shows a portion of a fourth toner supply guide 52*d*. The fourth toner supply guide 52*d* is formed of a film-shaped material of type (d) in FIG. 16. An upper part of the fourth toner supply guide is attached to the holder 70. Like the third toner supply guide 52*c*, the holder 70 is situated near the developing roller 51 so that a lower end portion or a free-end portion of the fourth toner supply guide 52*d* bites into the developing roller 51. Thus, the fourth toner supply guide 52*d* itself applies a predetermined contact pressure to the developing roller 51, similarly with the above.

Figure 11E:
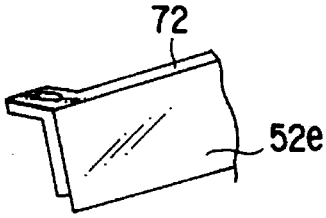
FIG. 11E is a perspective view showing a part of a fifth toner supply guide.

FIG. 11E shows a portion of a fifth toner supply guide 52*e*. Like the fourth toner supply guide 52*d*, the fifth toner supply guide 52*e* is formed of the film-shaped material of type (d) in FIG. 16. The fifth toner supply guide 52*e* is attached to an elongated attachment surface of a holder 72, and thus the length of the free end portion thereof is reduced. In this case, the attachment surface of the holder 72 is used as part of the fifth toner supply guide 52*e*. Accordingly, the fifth toner supply guide 52*e* with the film shape is reinforced. Similarly with the preceding examples, the holder 70 is situated near the developing roller 51 so that a lower end portion of the fifth toner supply guide 52*e* bites into the developing roller 51. Thus, the fifth toner supply guide 52*e* itself applies a predetermined contact pressure to the developing roller 51.

Some of the toner supply guides of types (a) to (d) in FIG. 16 are made of conductive materials. The black solid toner density is more stabilized, if a high voltage of the same polarity as that of the developing roller is applied to the conductive toner supply guide.

On the other hand, the first to fifth toner supply guides are attached at angles shown in FIGS. 12A to 12F.

Suppose that the attachment angle of the toner supply guide is defined by an angle θ at a highest point C of the toner supply guide or at an intersection between a line segment CD connecting the highest point C of the toner supply guide and a contact point D of the toner supply guide and developing roller 51 and a horizontal line AB of the horizontally situated image forming apparatus body 1.

Figure 12A:
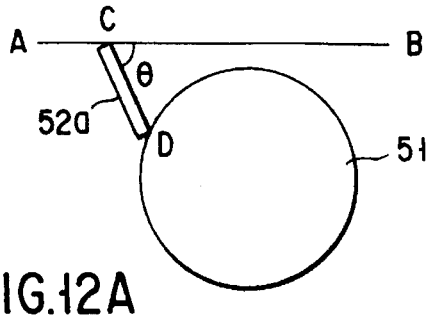
FIG. 12A illustrates the attachment angle of the toner supply guide shown in FIG. 9A.
Figure 12B:
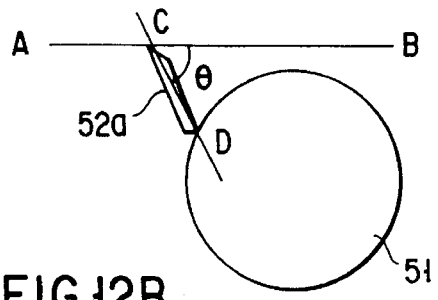
FIG. 12B illustrates the attachment angle of the toner supply guide similar to that shown in FIG. 9A.
Figure 12C:
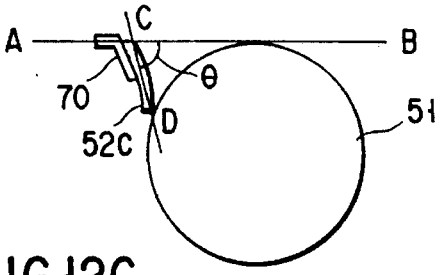
FIG. 12C illustrates the attachment angle of the toner supply guide shown in FIG. 11A.
Figure 12D:
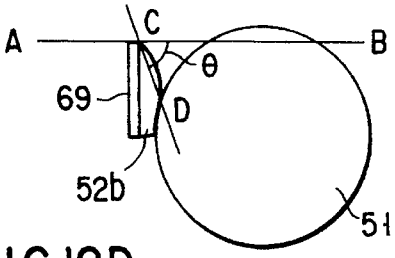
FIG. 12D illustrates the attachment angle of the toner supply guide shown in FIG. 10A.
Figure 12E:
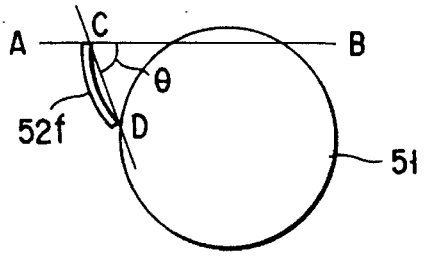
FIG. 12E illustrates the attachment angle of another toner supply guide.
Figure 12F:
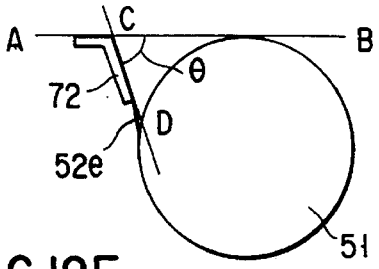
FIG. 12F illustrates the attachment angle of the toner supply guide shown in FIG. 11E.

FIG. 12A shows the attachment angle θ of the plate-shaped toner supply guide 52*a*. FIG. 12B shows the attachment angle θ of the toner supply guide 52*a* with a partially cut tip end portion. FIG. 12C shows the attachment angle θ of the plate-shaped elastic toner supply guide 52*c* which is warped to the inside of the line segment CD, i.e. towards the developing roller 51. FIG. 12D shows the attachment angle θ of the sponge-type elastic toner supply guide 52*b* put in pressure contact with the developing roller 51. FIG. 12E shows the attachment angle θ of a plate-shaped elastic toner supply guide 52*f* warped to the outside of the line segment CD, i.e. away from the developing roller 51. FIG. 12F shows the attachment angle θ of the toner supply guide 52*e*, a part of which is formed by using a slanting surface of the holder 72. In this case, the attachment angle θ is defined as an angle formed between the line segment CD connecting the highest point C of the holder 72 and the contact point D of the toner supply guide 52*e* and developing roller 51 and the horizontal line AB.

The above-described attachment angle of the toner supply guide is determined on the basis of the experimental results stated below.

Figure 13:
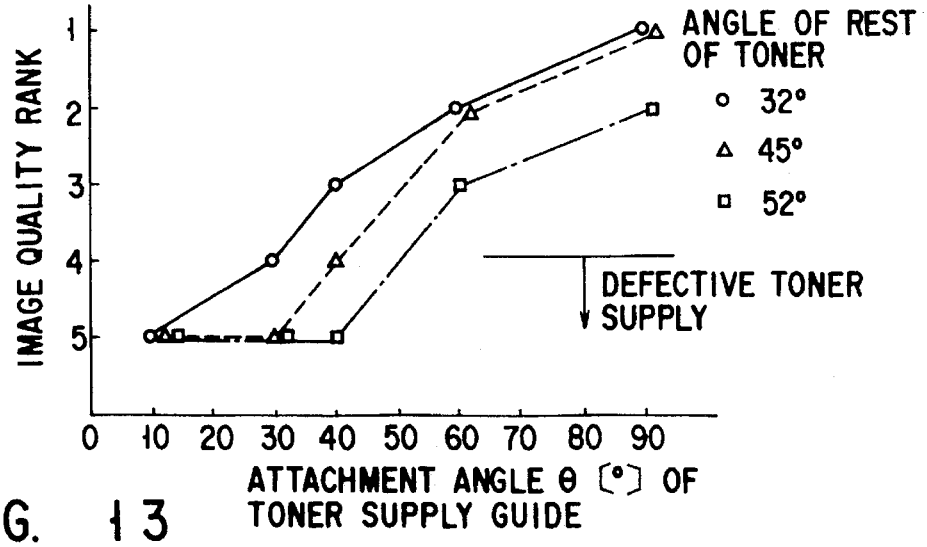
FIG. 13 is a graph showing the relationship between the attachment angle of the toner supply guide in the developing apparatus of the present invention and the image-quality rank.

FIG. 13 is a graph showing the relationship between the attachment angle θ of the toner supply guide, which is defined as described above, and the image-quality rank of an image developed by the developing apparatus provided with the toner supply guide. The image-quality rank depends on the attachment angle θ of the toner supply guide and indicates the toner supply performance of the toner supply guide for supplying toner to the developing roller. The image-quality rank is defined by ranks 1 to 5 in accordance with the density of an image printed out when data for a black solid image is prepared in the image forming apparatus. Rank 1 represents such image quality that the entire image is uniformly printed out at a reference-level density. Rank 2 represents such image quality that the density of a part of the printed-out image decreases and the degree of the decrease in image density is less than 0.05 with respect to the reference level. Rank 3 represents such image quality that the density of a part of the printed-out image decreases and the degree of the decrease in image density is 0.05 or more with respect to the reference level. Rank 4 represents such image quality that a part of the printed-out image is blurred. Rank 5 represents such image quality that the entire printed-out image is blurred.

In the experiments, three types of toners having different angles of rest as parameters were prepared. The angles of rest of the three types of toners are 32°, 45° and 52°. The angles of rest were measured by a powder tester manufactured by Hosokawa Micron.

The experiments were conducted through the following procedures. The toner supply guide was attached to the developing apparatus at an initial value of the attachment angle θ. Then, the toner having a specified angle of rest was supplied to the developing apparatus. Data for a black solid image was prepared in the image forming apparatus, and an electrostatic latent image corresponding to the data was formed on the photosensitive drum. Thereafter, the developing apparatus was driven to rotate the paddle 53*a* and elastic thin plate 53*b* thereof within the toner chamber 54, and sweep up the toner into the toner reservoir 58. The toner was supplied from the toner reservoir 58 to the developing roller 51. The electrostatic latent image was developed by the toner from the developing roller 51, and printed on the sheet P. The image quality of the printed image was evaluated and ranked. The same experiments were conducted with respect to the other two types of toners.

Subsequently, the attachment angle θ of the toner supply guide in the developing apparatus was varied to other values, and the experiments were conducted to obtain the relationship between the attachment angle θ and image quality rank. The relationship Obtained for each of three types of toners.

It was confirmed, from the experiments, that the images of ranks 4 and 5, which were blurred owing to deficient supply of toner, were output when the attachment angle was 30° or less in the case of the toner with the angle of rest of 32°, when the attachment angle was 40° or less in the case of the toner with the angle of rest of 45°, and when the attachment angle was 40° or less in the case of the toner with the angle of rest of 52°.

Based on the experimental results, it was understood that the attachment angle θ of the toner supply guide 52 must be equal to or greater than the angle of rest of the used toner. Thus, the toner supply guide in the developing apparatus of this invention is attached at an attachment angle equal to or greater than the angle of rest.

Next, the proper range of values of pressure at contact line of toner supply guide and developing roller (contact linear pressure) of the toner supply guide on the developing roller will be found.

Figure 14:
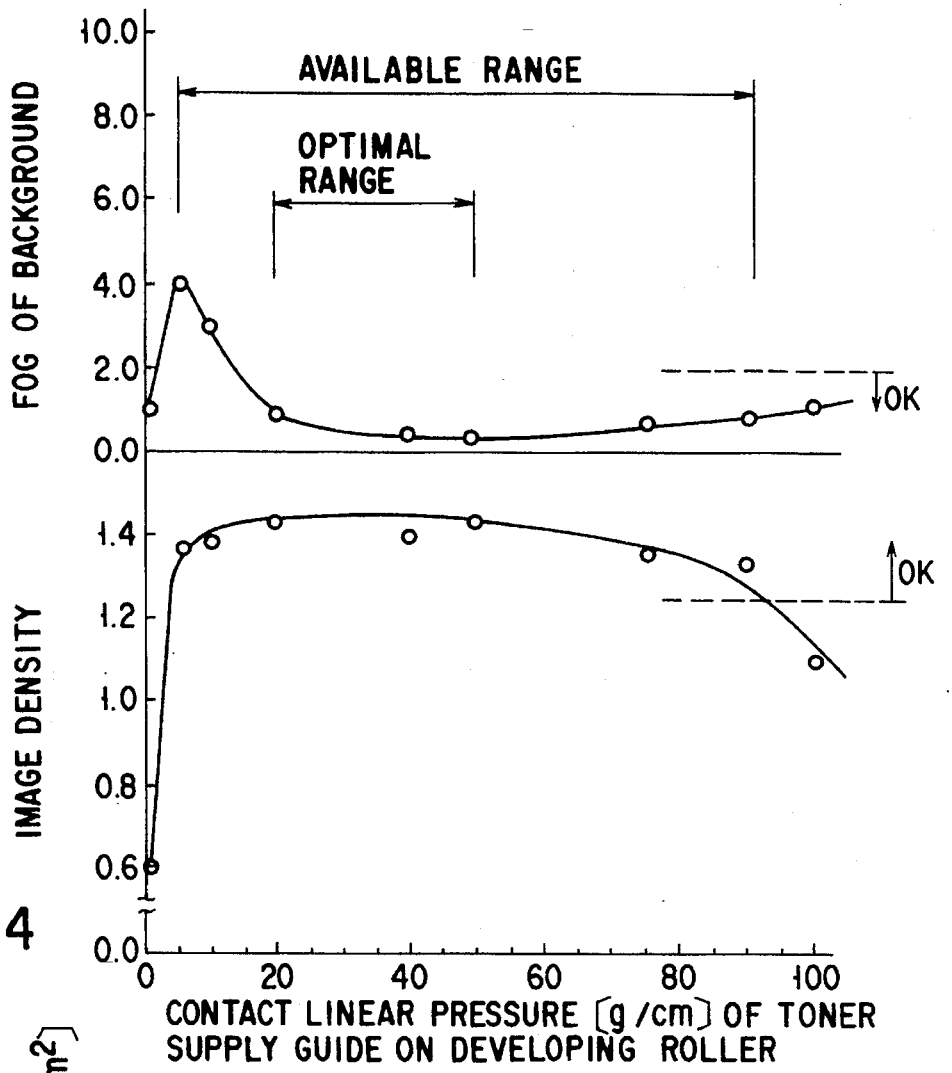
FIG. 14 is a graph showing the relationship between the contact linear pressure of the distal end portion of the toner supply guide shown in FIG. 11A upon the developing roller and each of image density and the background fog.

FIG. 14 is a graph showing the relationship between the contact linear pressure of the toner supply guide 52*c* upon the developing roller 51 in the developing apparatus shown in FIG. 11A, and each of image density of the printed-out image and the background fog.

Figure 15:
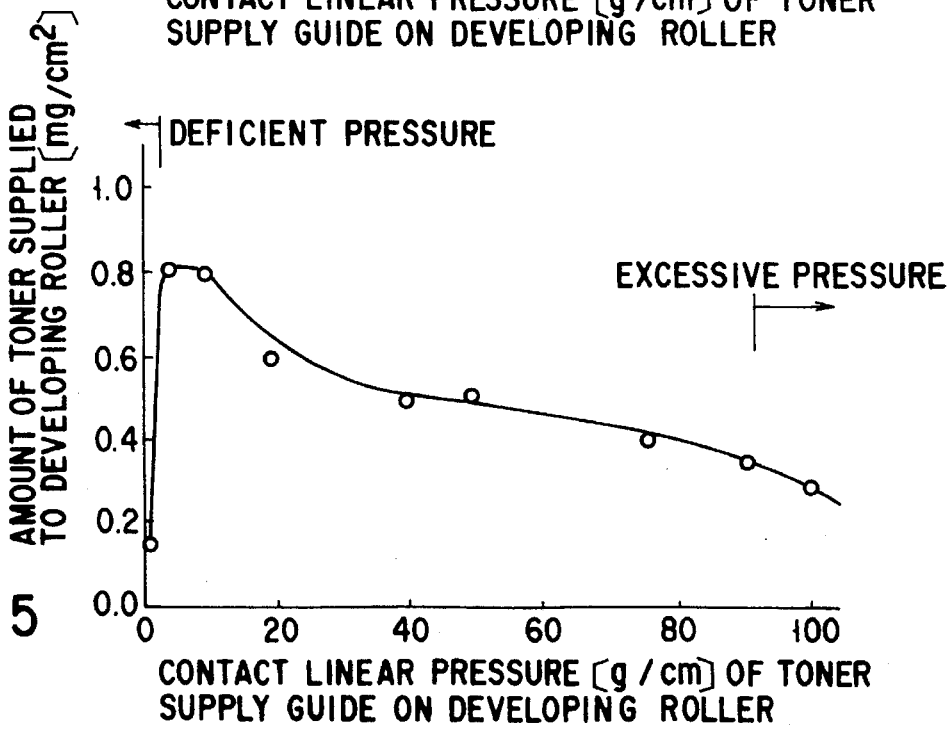
FIG. 15 is a graph showing the relationship between the contact linear pressure of the distal end portion of the toner supply guide upon the developing roller, and the amount of toner supplied to the developing roller under the pressure.

FIG. 15 is a graph showing the relationship between the contact linear pressure of the toner supply guide 52*c* upon the developing roller 51 in the developing apparatus shown in FIG. 11A, and the amount of toner supplied to the developing roller 51 from the toner reservoir.

It is understood, from the experimental data shown in FIG. 15, that the toner supply characteristics of the toner supply guide 52*c* depends on the contact linear pressure of the toner supply guide 52*c* on the developing roller 51. The toner supply amount increases as the contact linear pressure decreases, and the toner supply amount decreases as the contact linear pressure increases.

Accordingly, when the contact linear pressure of the toner supply guide 52*c* is low, as shown in FIG. 14, the toner supply amount is limited to some degree. In this case, however, the toner, which is greater in amount than can be charged, is supplied to the sheet via the developing roller 51, and part of the toner is not sufficiently charged. As a result, the fog density of the background region of the printed-out image increases.

On the other hand, when the contact linear pressure of the toner supply guide 52*c* is high, the toner supply amount is limited by the toner supply guide 52*c* and the toner to be supplied to the layer thickness limiting member 55 is deficient. Since the toner necessary for the development is not supplied, the image density tends to decrease.

Furthermore, when the contact linear pressure of the toner supply guide 52*c* is very low, the toner is not sufficiently supplied and the printed image blurs.

From the experimental data shown in FIGS. 14 and 15, it is understood that the available range of the contact linear pressure of the toner supply guide 52*c* on the developing roller is between 5 g/cm, at which the toner can be surely supplied to the developing roller, and 90 g/cm at which the limitation on the toner supply becomes conspicuous, and the optimal range is between 20 g/cm to 50 g/cm at which the image is stabilized. Accordingly, the toner supply guide in the developing apparatus of the present invention is put in contact with the developing roller at a contact linear pressure meeting the above condition.

As has been described above, the paddle and elastic thin member provided within the toner container of the developing apparatus are rotated to sweep up the toner within the toner container, thereby dispersing and supplying the toner into the toner reservoir defined by the toner supply guide and the part of the developing roller. When the distal end portion of the elastic thin member approaches the upper end portion of the toner supply guide, the former does not project over the latter. Thus, the toner is not pushed into the toner reservoir and does not cohere. Therefore, the toner can be smoothly supplied.

The toner supply guide is situated such that the toner is moved to the developing roller side by the weight of the toner itself and the direction of movement of toner coincides substantially with the direction of rotation of the developing roller. Thus, the toner can be smoothly supplied by the synergetic effect of the movement of the toner by its own weight and the torque of the developing roller.

Besides, the toner supply guide, is situated such that the attachment angle is equal to or greater than the angle of rest of the toner. Thus, the toner moves smoothly within the toner reservoir and the toner can be stably supplied.

Furthermore, the toner supply guide is situated such that the contact linear pressure of the toner supply guide on the developing roller is set in the range of 5 to 90 g/cm, preferably 20 to 50 g/cm. Thus, a proper amount of toner can be supplied to the developing roller and the deficiency of toner supplied to the developing roller can be prevented. Accordingly, an undesirable decrease in density of the printed image can be prevented.

Moreover, since the toner can be stably supplied to the developing roller, without using the supply roller, the apparatus can be reduced in size and thickness.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A developing apparatus for developing an electrostatic latent image formed on an image bearing body, said apparatus comprising:

a storing unit for storing a developer;

a developing roller rotated about a horizontal axis to supply the developer to said image bearing body;

a guide member, put in contact with a downwardly moving upper peripheral surface of the developing roller, for defining a temporary storage space of the developer along with the developing roller and for adhering to the developing roller the developer moving downward within the storage space by the weight of the toner itself;

charging means for charging the developer adhered to the developing roller; and ejecting means for ejecting the developer from the storing unit into the storage space.

2. The developing apparatus according to claim 1, wherein said charging means includes a layer thickness limiting member for limiting the thickness of the developer adhered to the developing roller at a constant value.

3. The developing apparatus according to claim 1, wherein said ejecting means includes an elastic portion for sweeping up the developer and a rotational body rotating within said storing unit.

4. The developing apparatus according to claim 3, wherein said rotational body is situated such that a distal end portion of the elastic portion does not project beyond an upper end portion of said guide member.

5. The developing apparatus according to claim 2, wherein said layer thickness limiting member is separated from the storing unit by partition means.

6. The developing apparatus according to claim 1, wherein the surface of the guide member is set an angle to a horizontal plane, which is equal to or greater than the angle of rest of the developer.

7. The developing apparatus according to claim 1, wherein the guide member is pressed on the developing roller under a pressure of 5 g/cm to 90 g/cm.

8. A developing apparatus for developing an electrostatic latent image formed on an image bearing body, said apparatus comprising:

a storing unit for storing a developer;

a developing roller rotated about a horizontal axis to supply the developer to said image bearing body;

a guide member for defining a temporary storage space of the developer in cooperation with a downwardly rotating surface of the developing roller at a position higher than a horizontal ideal plane passing through an axis of the developing roller, and for adhering to the developing roller the developer moving downward within the storage space by the weight of the toner itself;

a layer thickness limiting member for regulating the thickness of the developer adhered to the developing roller at a constant value; and ejecting means for ejecting the developer from the storing unit into the storage space.

9. The developing apparatus according to claim 8, wherein said guide member includes a contact end portion put in contact with said downwardly rotating surface of the developing roller.

10. The developing apparatus according to claim 9, wherein the contact end portion of the guide member is pressed on the developing roller under a pressure of 5 g/cm to 90 g/cm.

11. The developing apparatus according to claim 8, further comprising support means for supporting the guide member such that the surface of the guide member, which is opposed to the storage space, is set at an angle to a horizontal plane, which is greater than the angle of rest of the developer.

12. An image forming apparatus for forming an image in accordance with an external signal, said apparatus comprising:

an image bearing body;

charging means for charging the surface of the image bearing body at a predetermined potential;

exposing means for exposing the surface of the image bearing body in accordance with said external signal and forming an electrostatic latent image;

developing means for developing the electrostatic latent image on the image bearing body and forming a visible image, including a storing unit for storing a developer, a developing roller rotated about a horizontal axis to supply the developer to said image bearing body, a guide member for defining a temporary storage space of the developer in cooperation with a downwardly rotating surface of the developing roller at a position higher than a horizontal ideal plane passing through an axis of the developing roller, and for adhering to the developing roller the developer moving downward within the storage space by the weight of the toner itself, a layer thickness limiting member for regulating the thickness of the developer adhered to the developing roller at a constant value, and ejecting means for ejecting the developer from the storing unit into the storage space;

transfer means for transferring the visible image on the image bearing body onto a medium; and fixing means for fixing the visible image transferred onto the medium.

* * * * *